United States Patent [19]

Melton et al.

[11] 4,205,293

[45] May 27, 1980

[54] THERMOELECTRIC SWITCH

[75] Inventors: Keith N. Melton, Busslingen; Olivier Mercier, Ennetbaden, both of Switzerland

[73] Assignee: BBC Brown, Boveri & Company, Limited, Baden, Switzerland

[21] Appl. No.: 900,866

[22] Filed: Apr. 28, 1978

[30] Foreign Application Priority Data

May 6, 1977 [CH] Switzerland ..... 5698/77

[51] Int. Cl.[2] ..... H01H 61/04; H01H 61/06

[52] U.S. Cl. ..... 337/140; 337/139

[58] Field of Search ..... 337/139, 140, 141; 148/11.5

[56] References Cited

U.S. PATENT DOCUMENTS

| | | | |
|---|---|---|---|
| 3,012,882 | 12/1961 | Muldawer et al. | 75/151 |
| 3,285,470 | 11/1966 | Frei et al. | 75/151 |
| 3,516,082 | 6/1970 | Cooper | 337/140 |
| 3,567,523 | 3/1971 | Jackson et al. | 148/11.5 |
| 3,652,969 | 3/1972 | Willson et al. | 337/140 |
| 3,967,227 | 6/1976 | Clarke et al. | 337/140 |

FOREIGN PATENT DOCUMENTS

| | | |
|---|---|---|
| 2139852 | 8/1971 | Fed. Rep. of Germany . |
| 2026629 | 12/1971 | Fed. Rep. of Germany . |
| 2261710 | 6/1974 | Fed. Rep. of Germany . |
| 2516749 | 11/1975 | Fed. Rep. of Germany . |

OTHER PUBLICATIONS

Proceeding of IEEE, Publication, Sep. 1970, pp. 1365 & 1366.

*Primary Examiner*—Harold Broome

*Attorney, Agent, or Firm*—Oblon, Fisher, Spivak, McClelland & Maier

[57] ABSTRACT

A thermoelectric switch having a current conducting triggering element made from a shape memory alloy exhibiting a two way temperature effect and coupled to a stressing device which exerts a force on the triggering element to thereby determine the switching temperature of the thermoelectric switch. Mechanical switching amplification is actuated by the triggering element to interrupt current flow through the thermoelectric switch.

12 Claims, 13 Drawing Figures

THERMOELECTRIC SWITCH

BACKGROUND OF THE INVENTION

1. Field of the Invention

The invention relates to thermoelectric switches used for the protection of electrical circuits against slowly or rapidly rising current overloads.

2. Description of the Prior Art

Conventional switches of this type contain at least one element, through which the current flows and which triggers either the switching on or the switching off function, for example a bimetal strip which changes its shape as a consequence of the Joule energy arising from the current flow, and on exceeding the predetermined maximum value triggers the switching function. For protection against very rapidly increasing current overloads, for example for short circuit protection, bimetal strips are, however, mostly unsuitable, so that for such a switching function other elements through which the current flows such as magnetic switches or fuses are necessary.

Since the discovery of the so-called shape memory alloys in the year 1961 (U.S. Pat. No. 3,012,882) it has been repeatedly suggested that these raw materials, by means of particular shape or property changes concerned with structural alterations recoverable through the influence of temperature, be used for temperature sensitive electrical switches (U.S. Pat. Nos. 3,285,470; 3,516,082 and 3,652,969 and German Patents OS-2,026,629 and 2,139,852 as well as Proceedings of the IEEE September 1970, pages 1365/66).

The completely different applications of shape memory alloys suggested in the above mentioned patents are concerned with the indirect shape change occuring suddenly and only through the influence of temperature, which will be described in the following as the one-way effect because the shape ("memory shape") prior to raising the temperature is not regained on subsequently decreasing the temperature but must first be reformed mechanically.

For thermoelectric switches whose heat sensitive element consists of a shape memory alloy, a returning device would therefore be necessary, as for example is suggested in the German Patent OS 2,139,852 for a switching element with a temperature dependent switch position comprising a combination of a NiTi shape memory alloy switching element in the form of a spring which changes its spring force at the transformation temperature with a second switching element which has a relatively temperative independent spring force. The transformation temperature of the shape memory alloy thus determines the temperature at which the switch responds so that for several switching temperatures, which according to the state of the art should lie between −50° C. and +135° C., different compositions are necessary in each case.

This dependence of the response temperature on the composition of a shape memory alloy used (as a switch element) according to the state of the art, exists also in those cases which are concerned with the two way effect discovered later. This function of shape memory alloys, described in more detail below, is concerned with several mechanical or thermal treatment methods and apparata such that, within certain limits, a direct purely thermal resetting of the shape changing capacity characteristics of shape memory alloys is possible (U.S. Pat. No. 3,567,523; German Patent OS -2,516,749).

The application of shape memory alloys with the two way effect in place of bimetal strips, suggested in the above mentioned patents, avoids the necessity for a device for the mechanical resetting of the memory shape condition, but has, however, the disadvantage that the respective response temperature is determined in practice by the alloy composition.

Understandably, this relation between the response temperature and the composition of the shape memory alloy, inevitable according to the state of the art, impedes practically usable technical applications, and not only because of the fact that a different alloy composition or a different heating characteristic of the triggering element of the switching process is then necessary in practice for each required switching temperature, but also because for many known shape memory alloys it is not always easy to reproduce within narrow tolerances the critical alloy composition for achieving a particular response temperature.

SUMMARY OF THE INVENTION

Accordingly, the object of this invention is to provide a novel thermoelectric switch whose switching temperature is independent both of the specific critical response temperature of the shape memory alloy element used and, within a relatively broad range, of the alloy composition.

The invention is premised on the recognition that the temperature determined reversible change of state of products made from two way effect shape memory alloys can be influenced by means of externally applied forces, and that this can be advantageously utilized in a surprisingly simple way for the determination or alteration of the temperature response of thermoelectric switches which contain as the triggering element a shape memory alloy element exhibiting the two way effect. It has been further discovered that switching elements made of shape memory alloys exhibiting the two way effect doubly protect against slowly rising and rapidly rising currents and therefore not only can they be used instead of bimetal strips but can also simultaneously be used as electromagnetic switches or fuses and similar short circuit protectors.

The thermoelectric switch according to the invention contains at least one triggering element of the switching process made from a shape memory alloy exhibiting the two way effect, through which the current to be switched flows, and includes a stressing device acting on the element, whose acting force for example tension stress, compression stress or torsion stress is chosen and is adjustable in determining the temperature of the switching process.

The two-way effect here used as a differentiating criterion is obtained in general when a product made from a shape memory alloy in at least a partly martensitic condition shows a useful reversible shape memory effect on temperature cycling, as is explained in more detail below.

It is, however, to be noted that the notions of "martensitic" or "austenitic" correspond to particular metallurgical concepts whose general applicability is not quite definite. Both the one way effect and the two way effect have been, however, experimentally verified under clearly distinguishable conditions and are unequivocably defined by physical properties, for example a shape change factor defined below.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
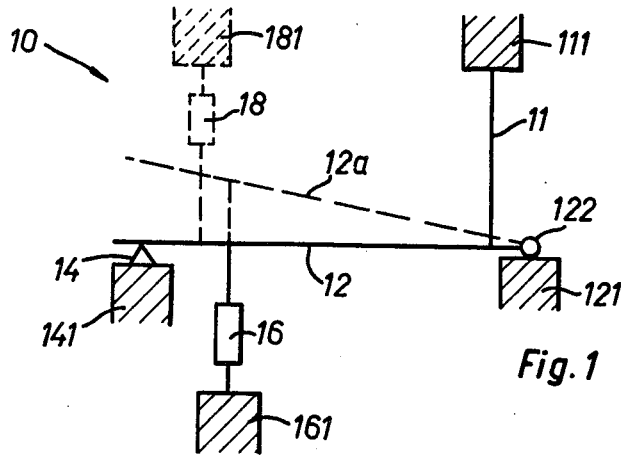
FIG. 1 is a schematic representation of a first embodiment of the switch according to the invention with a switching element of a shape memory alloy which contracts in the event of a temperature increase.

Referring now to the drawings, wherein like reference numerals designate identical or corresponding parts throughout the several views, and more particularly to FIG. 1 thereof, there is seen a construction of a switch according to a first embodiment of the invention wherein a long wire rod, strip or similarly formed switching element 11 of a shape memory alloy with an $M_s$ temperature towards the lower end of the required switch temperature response range. Examples of suitable or preferred alloy compositions are further described below. The switching element 11 exhibits a two way effect of, for example, 1–2% which, as is also further described below, is obtainable through a corresponding pre-treatment and which within a particular temperature range causes the element to contract when the temperature increases and to expand again when the temperature decreases.

One end of the switching element, as shown in the drawing the top end, is connected to a clamp 111, and the other end of a switching arm 12. This switching arm is pivotable about the hinge 122 connected to the clamp 121 and in the position drawn in unbroken lines lies on a contact 14 mounted in a holder 141. The contact 14 or its mount 141 is connected to an electrical circuit, not shown in the figure, and the current to be switched flows through the contact 14, the arm 12 and the switching element 11 to the electrical circuit, also not shown in the figure, which is connected to the switching element 11 by the clamp 111.

One of the ends of a stressing device 16, e.g. a spring, is joined to the switching arm 12 and the other end is held by the clamp 161. The contraction stress produced by temperature increase and austenite formation in the switching element 11 is opposed by the force or stress produced by the stressing device 16 on the switching arm 12 and correspondingly via its lever action on the switching element 11.

With respect to the direction of hinging of the switching arm 12 following the temperature controlled shape memory contraction of the switching element 11, it is to be understood that in place of or in addition to the opposingly acting tension force of the stressing device 16, the corresponding compression force of a compression stressing device acting in the same direction can be used, as is illustrated in FIG. 1 by the stressing device 18 shown in dotted lines. This additional or alternative device 18, e.g. a compression spring or the like, is connected on one side to the switching arm 12 and on the other side to the clamp 181.

When the temperature of the switching element 11 is raised above its response temperature by Joule heating from the current flowing through it, the characteristic transformation of the martensitic structure or the martensitic parts of the stucture of shape memory alloys exhibiting the two-way effect into the more or less austenitic structure takes place. As the switching element 11 illustrated here is shorter in its at least partly austenitic condition than in its martensitic condition, the switching arm 12 is moved from the switched on to the switched off position when the tensile stress created in the switching element 11 by the formation within it of the austenitic phase or some regions of the austenitic phase, is greater than the tensile force or tensile stress on the switching element 11 produced by the stressing device 16 and/or 18 acting through the switching arm 12. Obviously, there is taken into account the lever action depending on the distance between on the one hand the point of action of the stressing device 16 and/or 18 on the switching arm 2 and on the other hand on the point of action of the switching element 11 on the switching arm 12.

The force of the stressing device 16 and/or 18 necessary for the determination or the changing of the switching temperature is further described below. However, it may be noted here that in place of the tension or compression springs of the stressing device, other well known devices could be used including those of a hydraulic, pneumatic or magnetic kind, which could exert with or without a lever action a predeterminable tension compression or torsion stress on the switching element.

Figure 2:
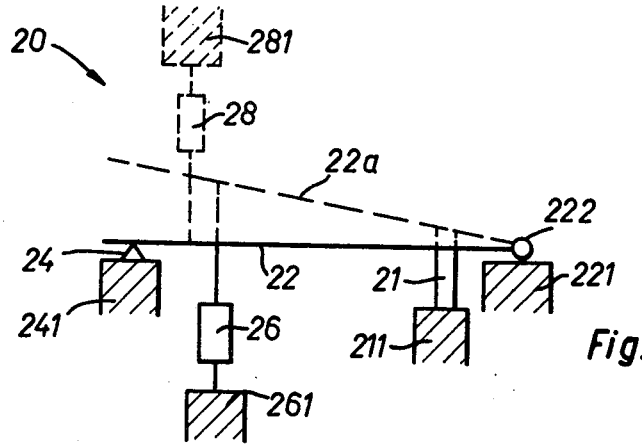
FIG. 2 is a schematic representation of a second embodiment of the switch according to the invention with a switching element of a shape memory alloy which expands in the event of a temperature increase.
Figure 3:
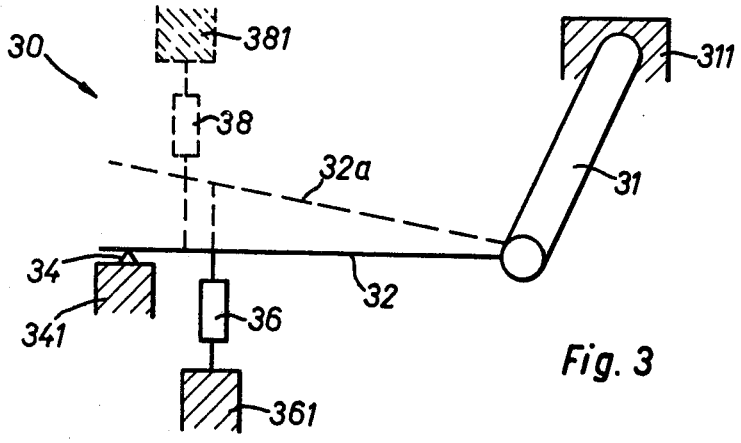
FIG. 3 is a schematic representation of a third embodiment of the switch according to the invention with a switching element of a shape memory alloy which twists in the event of a temperature increase.

FIGS. 2 and 3 schematically illustrate further embodiments corresponding to the invention of switches 20 and 30 respectively, in which the switching elements 21 and 31 trigger the switching process as a result of the two way shape memory transformation, expansion and twisting respectively, determined by a rise in temperature and can override a compression stress (FIG. 2) or a torsion stress (FIG. 3). The method of representation of FIG. 2 corresponds to that of FIG. 1, while for improved clarity the switching element 31 of FIG. 3 is drawn in perspective. In both cases the current to be switched flows through the switching element 21, 31, via circuits which are not shown, from the mounting 241, 341 of the contact 24, 34 to the mounting 211, 311 of the switching element 21, 31.

The compression or torsion stress produced in the switching element 21 or 31 respectively can, by analogy to the explanation in connection with FIG. 1, be compensated by an opposingly acting tensile force of the stressing device 26 or 36 and/or by an opposingly acting compression force of the stressing device 26 or 36 as well as by an opposingly acting torsion device until the required switching temperature is reached.

Figure 4:
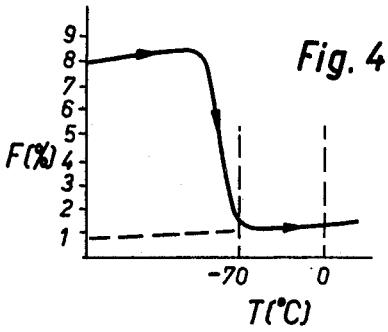
FIG. 4 is a schematic representation of a functional mode of a shape memory alloy exhibiting the one way effect.
Figure 5:
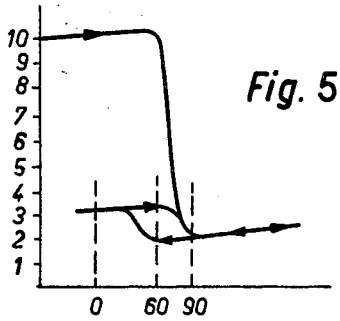
FIG. 5 is a schematical representation of a functional mode of a shape memory alloy exhibiting the two way effect.

FIGS. 4 and 5 serve as explanation of the one-way and two-way effect of shape memory alloys by means of curves in which the factor F of percentage change, for example the percentage length change $$\frac{\Delta L}{L} \times 100,$$

is plotted for given shape memory alloys as ordinate against the temperature abscissa. This factor can, for shape memory effects achieved in tension or compression, be described as the amount of deformation and may be specified as a positive or negative length change. However, for shape memory effects achieved in torsion, the external shape change expressed as a length change is of little meaning and quoting a degree of deformation is, under the circumstances, misleading.

The shape memory alloy, whose shape change factor/temperature curve is represented in FIG. 4, consists of a known shape memory alloy Ni/Ti/Fe in proportions 53/45/2 by weight, in the form of a cylindrical rod which is axially compressed ("stressed") by 8% at a low temperature and which on heating above the critical temperature returns almost to its length before the compression (memory shape). On further cooling to temperatures below −70° C., the condition previously achieved by deformation cannot be obtained unless the rod is further deformed at low temperature. One supposes that this effect, described for several alloy systems and compositions, depends on a particular type of phase transformation (Martensite transformation). Martensite is looked upon as the low temperature phase which is formed from the high temperature phase (austenite) by means of a shear process. A nucleation energy is necessary for martensite formation. This energy is much lower for shape memory alloys than for the formation of martensite in steels, which show no useful shape memory effect. The existence of a nucleation energy means that on cooling, martensite is first formed at a temperature $M_s$, below the temperature $T_o$ at which the two phases would be in thermodynamic equilibrium. The transformation ceases at a temperature $M_f < M_s < T_o$. At temperatures just above $M_s$ an applied stress can provide a contribution to the nucleation energy for the martensite.

On heating, the shape memory alloys behave in reverse. Austenite is first formed at a temperature $A_s > T_o$ and the austenite transformation is complete at a temperature $A_f > A_s > T_o$.

On heating the martensite, only the original orientations of the austenite can be produced. This means that for a stress-induced matensite, the shape change produced by deformation can be regained on heating. Thus the one-way effect is based on the formation by deformation of a new phase (Martensite) or new orientations of the martensite, and the reformation of the original phase on heating.

If a shape memory alloy product is further deformed beyond a critical strain, irreversible plastic deformation occurs, nevertheless the shape of the product is partly recovered on heating. This probably depends on the fact that lattice defects created by plastic deformation do not completely anneal out after heating, and that on cooling their internal stress field favors the formation of those martensite orientations originally produced by an applied stress. On subsequent thermal cycling a purely thermally dependent shape reversibility is observed, which is described here as the two way effect. The previously known maximum strains for the one- and two-way effects are 8% and 1.5% respectively.

The shape memory alloy which is the basis for FIG. 5 is a new alloy developed by the inventor containing as well as Ni and Ti also Cu up to 30 wt% together with optional modifying elements and which is described in more detail below. It is, however, emphasized that the two way effect necessary for the triggering element of the switch according to the invention, can be achieved using fundamentally known methods, not only with this alloy, but also with other shape memory alloys, sometimes with another explanation of the effect, which are known from the literature (see for example U.S. Pat. No. 3,567,523, German Patents AS-2,261,710 and OS-2,516,749).

The specimen used for the determination of FIG. 5 is a cylindrical rod of shape memory alloy 45 wt% Ni, 45 wt% Ti 10 wt% Cu, which was compressed at room temperature by more than the 8% limit up to which the one way effect, represented in FIG. 4, can be achieved, in this case to approximately 10% of its length. On heating above the critical temperature the rod which had thus been treated expanded suddenly to almost its length before the deformation (memory shape) and the two way effect achievable by over stressing appeared on subsequent cooling and reheating cycles, to temperatures below and above the critical temperature range respectively of the corresponding hysteresis curve of contraction and expansion, i.e., a two-way effect with a shape change factor (herein again $$\frac{\Delta L}{L} (\times 100))$$

of approximately 1.5% is obtained.

The thermally reversible shape memory effect appears in this special case e.g. at temperatures of approximately 60° C. corresponding to the values of the $A_s$ or $M_s$ temperatures and it was expected on the basis of the teaching of the state of the art, that this response temperature can be influenced only by changing the alloy composition. Surprisingly, this is not the case. Rather, the response temperature of the thermally reversible shape memory change can be displaced in the sense of a broadening of the hysteresis loop of FIG. 5 in the direction of higher temperatures with the help of an externally applied force, in fact by a significant amount, e.g. by several times the length of the loop. The magnitude of the force or stress necessary for such a modification depends upon the particular alloy composition used, the thermal and mechanical pretreatment and the dimensions of the switching element made out of the shape memory alloy, but can in each case be determined without particular difficulties, e.g. as is explained in FIG. 6.

Figure 6:
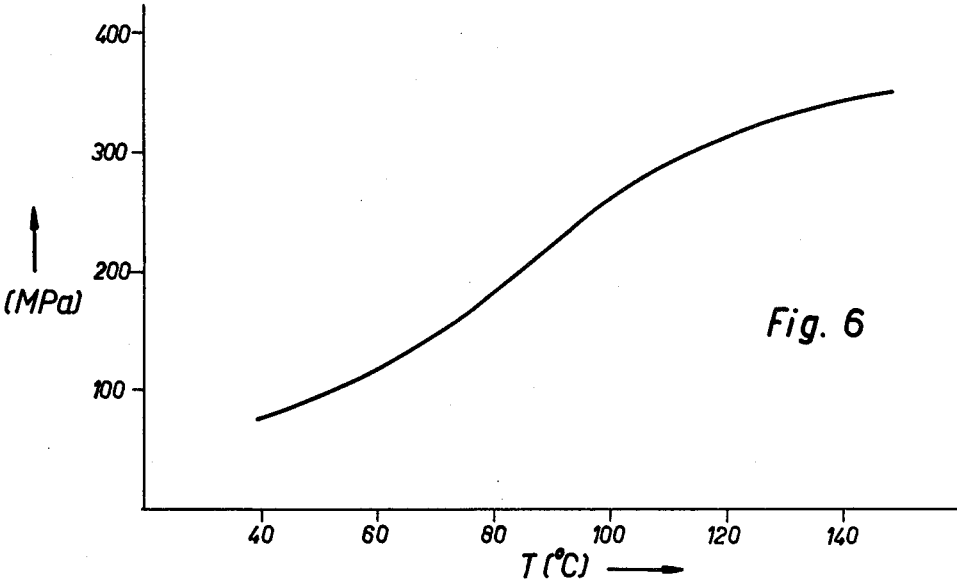
FIG. 6 is a stress-temperature curve of a switching element of a shape memory alloy exhibiting the two way effect.

FIG. 6 shows the variation of the stress (plotted on the ordinate in megapascal; 1 MPa~0.1 kg/mm$^2$) as a function of temperature (abscissa, in °C.) of a shape memory alloy (45.5 wt% Ti, 44.5 wt% Ni, 10 wt% Cu) switching element with the two way effect, which was clamped at both ends. The switching element was in the form of a swaged wire, whose memory shape had been modified in tension for the realization of a two way memory effect of approximately 1% (contraction on heating above the $A_f$ value and thermally reversible strain on cooling corresponding to FIG. 5).

By means of the curve in FIG. 6, that force or stress can be determined which, on application of this wire as the switching element 11 in a switch of the type represented in FIG. 1, is suitable for obtaining, with the help of the (tension) stressing device 16 and/or the (compression) stressing device 18, a desired response or switching temperature which lies above the $A_f$ value.

As indicated above, quite diverse shape memory alloys can be used for the triggering switch element of thermoelectric switches corresponding to the invention. For cost reasons and because of the desirable strength, shape memory alloys based on Ni/Ti/X or on Cu/Zn/X are currently preferred, in which X refers to at least one modifying element. The preferred element X is Cu for Ni/Ti and Al for Cu/Zn. The new Cu modified Ni/Ti shape memory alloys particularly preferred for the above invention can be thereby characterized, that they contain essentially nickel, preferably in amounts from 23–55 wt%; titanium, preferably in amounts from 40–46, 5 wt%; and copper in amounts up to 30 wt%, and in the case of an additional modifying addition contain at least one of the elements from the group Al, Zr, Co, Cr and Fe, where the cumulative modifying addition can be used in amounts of up to 5 wt %.

Preferred composition ranges and specific examples of the preferred shape memory alloys are summarized in the following tables I and II.

TABLE I

| | Alloy composition in wt% | | | | | | | |
|---|---|---|---|---|---|---|---|---|
| Nr. | Ni | Ti | Cu | Al | Zr | Co | Cr | Fe |
| 1 | 23–55 | 40–46.5 | 0.5–30 | 0–5 | 0–5 | 0–5 | 0–5 | 0–5 |
| 2 | 23 | 46.5 | 0.5 | 0–5 | 0–5 | 0–5 | 0–5 | 0–5 |
| 3 | 43.5–54.5 | 44.5–46.5 | 0.5–10.5 | — | — | — | — | — |
| 4 | 53.5–54.5 | 44.5–45.5 | 0.5–1.5 | — | — | — | — | — |
| 5 | 49.5–50.5 | 44.5–45.5 | 4.5–5.5 | — | — | — | — | — |
| 6 | 44.5–45.5 | 44.5–45.5 | 9.5–10.5 | — | — | — | — | — |
| 7 | 48.5–49.5 | 45.5–46.5 | 4.5–5.5 | — | — | — | — | — |
| 8 | 44.5–45.5 | 45.5–46.5 | 8.5–9.5 | — | — | — | — | — |
| 9 | 43.5–44.5 | 45.5–46.5 | 9.5–10.5 | — | — | — | — | — |
| 10 | 45–55 | 40–46.5 | 0.5–10 | 0–5 | 0–5 | 0–5 | 0–5 | 0–5 |
| 11 | 45–55 | 43–46.5 | 0.5–10 | 0.5–5 | — | — | — | — |
| 12 | 45–55 | 44–46.5 | 0.5–10 | — | — | 0.5–5 | — | — |
| 13 | 45–55 | 44–46.5 | 0.5–10 | — | — | — | 0.5–5 | — |
| 14 | 45–55 | 44–46.5 | 0.5–10 | — | — | — | — | 0.5–5 |
| 15 | 45–55 | 40–46.5 | 0.5–10 | — | 0.5–5 | — | — | — |

TABLE I-continued

| | Alloy composition in wt% | | | | | | | |
|---|---|---|---|---|---|---|---|---|
| Nr. | Ni | Ti | Cu | Al | Zr | Co | Cr | Fe |
| 16 | 44.5 | 45.5 | 10 | — | — | — | — | — |

TABLE II

| Alloy | Alloy composition in wt % | | | | $M_s$ |
|---|---|---|---|---|---|
| Nr. | Ni | Ti | Cu | | (°C.) |
| 101 | 54 | 45 | 1 | — | +35 |
| 102 | 50 | 45 | 5 | — | +52 |
| 103 | 49 | 46 | 5 | — | +66 |
| 104 | 45 | 45 | 10 | — | +50 |
| 105 | 44 | 46 | 10 | — | +55 |
| 106 | 45 | 46 | 9 | — | +55 |
| 107 | 44 | 45 | 10 | Co: 1 | +43 |
| 108 | 43 | 46 | 10 | Co: 1 | +15 |
| 109 | 44 | 45 | 10 | Fe: 1 | −21 |
| 110 | 43 | 46 | 10 | Fe: 1 | + 9 |
| 111 | 45 | 44 | 10 | Al: 1 | −13 |
| 112 | 44 | 45 | 10 | Al: 1 | 0 |
| 113 | 43 | 46 | 10 | Al: 1 | +12 |
| 114 | 44 | 45 | 10 | Cr: 1 | −13 |
| 115 | 43 | 46 | 10 | Cr: 1 | −25 |

As the phase transformation critical for the shape memory effect occurs very rapidly, e.g. in less than 10 milliseconds, the switching speeds of switches corresponding to the invention are not for practical purposes restricted by the kinetics of this transformation.

Also, because relatively large forces can be produced with the shape memory effect, e.g. up to 70 kp/mm$^2$ for Ni/Ti, a mechanical switching amplification is not in itself critical. A switch, essentially corresponding to that in FIG. 1 with a wire as described in connection with FIG. 6, has shown its suitability for the repeated thermally triggered switching of A.C. voltages (220 or 380V) with nominal currents of 10–100 A, and provides the additional advantage that it responds not only to a slowly rising overcurrent but also to a short circuit current.

Switches according to the invention can however also be combined with mechanical switching amplifications of essentially known or modified types, for example for automatic switching but not self-resetting overcurrent safety switches, or for automatically resetting switches for the protection of circuits against short circuit currents appearing for short times, as is explained in the following discussion by means of examples.

A switch corresponding to the invention for the automatic switching of overcurrents is illustrated semi-schematically in the FIGS. *7a, 7b, 7c* in the switched-on position (FIG. *7a*) switched-off position (FIG. *7b*) and reset position (FIG. *7c*). The triggering element 71 is a wire out of a shape memory alloy with a two-way effect of approximately 1% produced by deformation and heat treatment, in the sense that the wire on heating in the range of the two way effect shows a reversible contraction of its length of 1%. The switching element 71 is mounted at 712 to the switching arm 72, which is pivotable about the stationary hinge 720. A tension spring 76 acts on the switching element 71 as a stressing device for the determination of the switching temperature.

In the illustrated switched-on position the current flows through the conductor 742, the switching element 71, the end piece 711, the conductor 743, the connector 744, the contact piece 739 of the contact switching arm 73 to the fixed contact 74 and the current connector 741 of the contact.

The principle of the mechanical switching amplification described here is concerned with the action of the compression spring 737, one of whose ends is held by the mount 738 and whose other end presses against the arm 73 through the mount 736, which has a fixed pivot 730. The compression force of the spring 737 cannot break the connection between the contact 74 and the contact end 739 as long as the connecting arm 777, which acts through the traversable hinge 732 on the arm 73, is held in the position shown.

The switching element 71 is heated as a consequence of a slowly or rapidly rising current flow. The response or switching temperature depends upon the corresponding curve of the temperature dependence of the mechanical stress (FIG. 6) and upon the respective mechanical stress of the tension spring 76 used here as a stressing device which acts on the switching element 71.

At the response temperature, the switching element 71 contracts relatively abruptly, so that the arm 72 is rotated about the fixed pivot in a clockwise direction, whereby the hook 721 in the slot of the catch 793 of the angle arm 79 moves upwards and releases the catch 793. The force of the compression spring 737 acts through the connecting arm 777 and exerts a force on the guiding piece 791 via a guiding pin, located near the hinge 775 on the rear side of the connecting arm 777, which is not recognizable in the FIGS. *7a, 7b* and *7c*. As soon as the catch 793 is no longer held by the hook 721, the guiding pin slides to the left in the slot 792 of the arm 79, whereupon the arm 79 swings in a counterclockwise direction and the current carrying connection between the contact 74 and the end of the arm 739 is broken. This leads to the intermediate position of the switch 70 shown in FIG. *7b*.

The tension spring 778, one of whose ends lies in the clamp 779, rotates the switching lever 77 about its fixed hinge 770 and via the traversable hinge 772 pulls the connecting arm 777 and thereby the guiding pin situated at its ends to the left end of the slot 792. The angle arm 79 is thereby rotated clockwise and the hook 721 engages again in the catch of the arm 79. The rest position shown in FIG. *7c* is now reached. No mechanical stress is exerted on the switching element 71 as it cools, because the element 71 is able to slide in the guide 751 of the arm 75, the purpose of which is the sure avoidance of the formation of unwanted memory effects in the element 71.

In order to return the switch 70 to its switched-on position, the switching lever 77 is rotated, e.g., manually, until the position shown in FIG. *7a* is reached.

The switch illustrated in the FIGS. *7a, 7b* and *7c* can perform the function of a known switch possessing both a bimetal strip for the switching of a slowly rising overcurrent and a magnetic coil for the switching of short circuit currents. The switching element 71 of a shape memory alloy exhibiting the two way effect has thus the advantage of a double function and additionally the advantage that the contact breaking occurs only after exceeding an applied mechanical stress, and thus the observed instability of known switches against slowly rising currents is prevented. Thereby the same mechanical acceleration stress is available for an overload current and for a short-circuit current.

Figure 8:
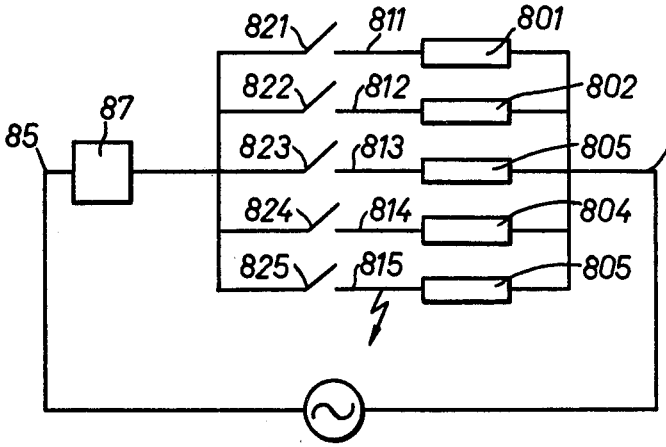
FIG. 8 is an example of a switching system including a number of parallel switched electrical appliances, which are to be protected against short circuit currents by means of a switch according to the invention.
Figure 7A:
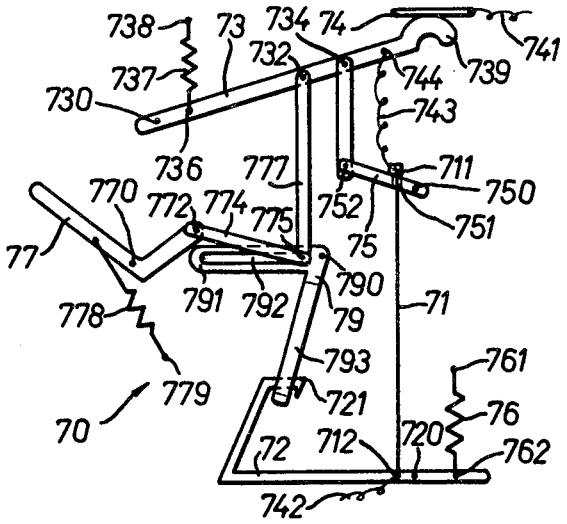
FIGS. 7*a*, 7*b* and 7*c* are semi-schematic representations of several positions of a further embodiment of the switch according to the invention with mechanical amplification.
Figure 7B:
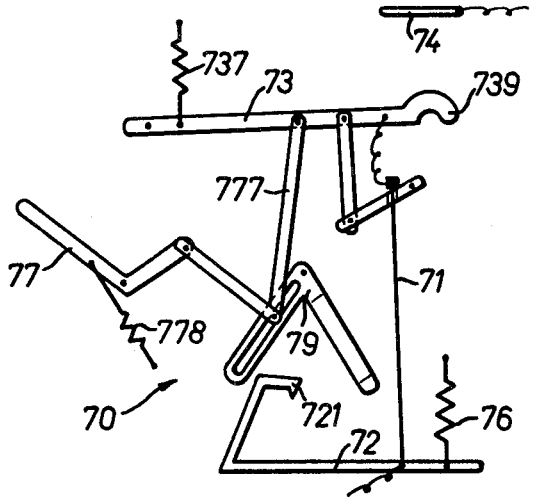
Figure 7C:
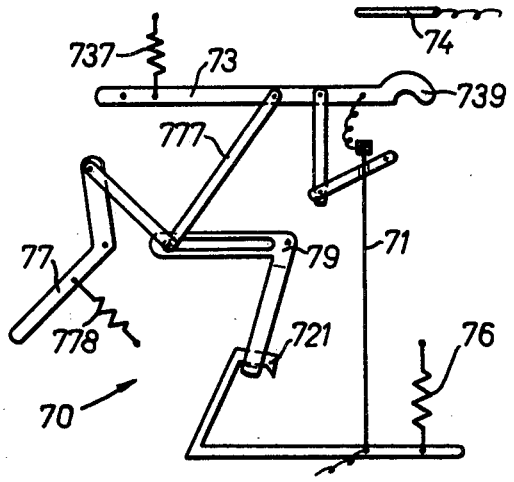
Figure 9A:
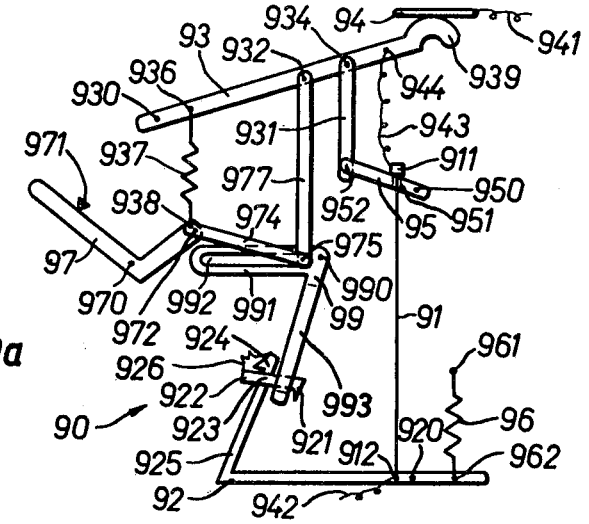
FIGS. 9*a*, 9*b* and 9*c* are semi-schematic representations of several positions of a suitable embodiment of a switch according to the invention for the switching system of FIG. 8.
Figure 9B:
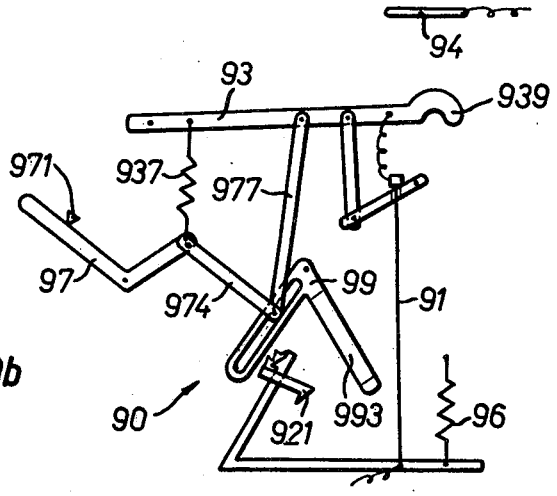
Figure 9C:
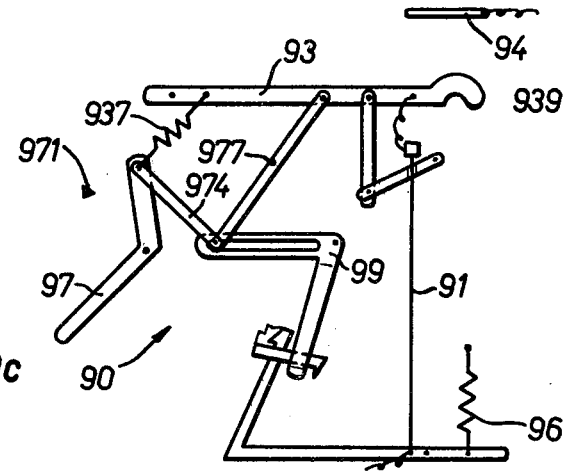

The circuit shown in FIG. 8 illustrates a system suitably protected by a thermoelectric main switch with automatic resetting. In the circuit 80 several electrical appliances 801 to 805 e.g. motors, are connected in parallel. When a short circuit occurs in one of the current branches 811 to 815, e.g. in branch 815, the respective current branch protector 825 disconnects the current in this branch and the appliance 805 has no current. The short circuit current, however, also flows through the main circuit 85, 86 and a corresponding part of it through the appliances 801 to 804. In order to protect these, a main protector 87 is necessary. When this opens on short circuit loading and has an automatic resetting function, it can quickly close again after the disconnection of the short circuited branch, here by the protector 825, so that the appliances 801 to 804 continue to run.

The switch 90 corresponding to the invention, which is suitable as a protector for circuits of this type, is illustrated semi-schematically in the FIGS. *9a, 9b* and *9c*. The wire-shaped triggering switching element 91 according to this embodiment consists of a shape memory alloy exhibiting a two-way effect of approximately 1%, acts through the switching arm 92, which is pivotable about the fixed hinge, with the stressing device consisting of a tension spring 96 for the determination of the thermal switching point in the manner described above. One of the ends of the tension spring 96 is in a clamp 961, the other end is situated in the joint 962 on the arm 92. The current flows through the connecting wire 942 and the clamp 912 through the switching element 91, the end of which slides in the slot 951 of the joining arm 95 and possesses an end stop 911, and through the connecting wire 943 which is joined to the contact end 939 of the arm 93 at the clamp 944. In the working position the contact end 939 is pressed by the compression spring 937 against the fixed contact 94, which is coupled to a circuit by the connecting wire 941.

In the event of short circuit currents, the switching element 91 contracts against the tension of the spring 96, so that the releasing arm 92 is rotated clockwise. The short arm 922, which is on the end of the angled part 925 of the arm 92 and is partly rotatable about the hinge 923, has a hook 921 which engages in the slotted latch part 993 of the angle arm 99 and which prevents rotation in the counterclockwise sense.

The amount of rotation of the short arm 922 is limited by the support 924 on the angled part 925 and the spring 926 pulls the short arm 922 against the support 924.

The compression spring 937 acts on the one end through the spring clamp 936 on the switching arm 93 and presses the contact end 939 of the arm 93 against the contact 94. The other end of the spring 937 acts through the clamp 938 on the switching lever 97, which is rotatable about the fixed hinge 970 and which is supported by the fixed stop 971, and through the traversable hinge 972 on the connecting arm 974 which interacts with the switching lever 97. Under the traversable hinge 975 of the connecting arm 974 is provided a guiding pin, not recognizable in the drawings, with which the connecting arm 974 and the connecting arm 977 are joined to the angle arm 99. The guiding pin can slide in the slot 992 of the guide 991, if the angle arm 99 is not engaged by the switching arm 92.

If the hook 921 releases the latch 993 as a consequence of a contraction of the switching element 91 determined by a short-circuit current, the angle arm 99 is rotated in a counterclockwise direction about the fixed hinge 990 and the switched-off position illustrated in FIG. *9b* is attained.

Upon cooling of the switching element, it expands in length again and the spring 937 resets the switch automatically in the working position of FIG. *9a*, whereby the hook 921, held by the spring 926, engages in the latch 993 of the arm 99.

The switching lever 97 has the sole function of an emergency off switch, i.e., it can be manually brought into the switched off position illustrated in FIG. *9c*, without the switching element 91 coming into operation by sliding of the end piece 911 in the slot 951 of the joining arm 95 until the end piece 911 is engaged. The switch 90 fulfills the task of current interruption, which previously was mainly done by fuses, and has the great advantage that it can immediately render operable the circuits it protects.

The tension stressing device in the form of a tension spring, used in the specific example of a preferred embodiment of the switch corresponding to the invention, can be replaced by other tension stressing devices and/or compression stressing devices acting in the opposite direction. The stressing device can advantageously be constructed such that the tensile stress acting on the switching element can be adjusted or altered. Suitable methods, e.g. an adjusting nut guided in a support and acting on a stressing device with a threaded end, are known to the expert and require no special explanation.

Also the choice of corresponding dimensions of cross section and length of the shape memory alloy triggering switching element, taking into consideration the nominal current density for which a switch according to the invention is to be designed, is a matter for those competent in the art, as the conductivity of suitable alloys is known or can be determined by simple experiments.

The cross sectional shape of the triggering switching element is not really critical. In place of the wires described in the preferred embodiments, shape memory alloys which contract on heating can be used as switching elements in other generally long shapes, with circular, oval or rectangular cross sections, whereby the element has a constant or changing cross section along its length. However, for the purpose of providing as simple as possible switch construction, the triggering element of the switching process is preferably designed so that its triggering force is a tensile force.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A thermoelectric switch comprising:

a current conducting triggering element made from a shape memory alloy exhibiting a two way temperature effect such that a thermally controlled transformation occurs when said triggering element passes from a partly matensitic state into an at least partly austenitic state, said triggering element then contracting, and when said triggering element reverses through the said transformation, said triggering element then expanding;

at least one stressing device operatively connected with said triggering element, said stressing device exerting force on said triggering element with said force determining the switching temperature of the switch;

means for movably supporting said triggering element; and circuit means contacting said triggering element as a result of said transformation.

2. A switch according to claim 1, wherein said triggering element is formed of an alloy comprising:

copper, zinc and aluminum.

3. A switch according to claim 1, wherein said triggering element is formed of an alloy comprising:

nickel and titanium.

4. A switch according to claim 3, wherein said alloy further comprises:

copper in amounts of up to 30% of the weight of the alloy.

5. A switch according to claim 3, wherein said alloy further comprises:

at least one element from the group consisting of aluminum, cobalt, copper and iron.

6. A switch according to claim 4 in which said alloy comprises in weight percent:

23–55% nickel, 40–46.5% titanium and 0.5–30% copper.

7. A switch according to claim 4, wherein said alloy comprises:

45±1% nickel, 45±1% titanium and approximately 10% copper.

8. The switch of claim 1, wherein said stressing device produces a force opposing said contracting of said triggering element.

9. The switch of claim 1 further comprising:

means for preventing said stressing device from acting on said triggering element during said expanding thereof upon said transformation from said at least partly austenitic state into said at least partly martensitic state.

10. The switch of claim 8, said means for contacting said triggering element comprising switching amplification means actuated by said triggering element for interrupting current through said triggering element.

11. A switch according to claim 10 wherein said switching amplification means comprises:

a fixed hinge;

a release arm rotatable about the fixed hinge and connected to the stressing device and the triggering element;

a rotatable angle arm releasably connected to said rotatable release arm whereby the connection of the release arm to the rotatable angle arm is released upon contraction of the triggering element against the action of the stressing device;

a joining arm braced at one end to the rotatable angle arm and transferring motion of the rotatable angle arm;

a switching arm pressed by the joining arm and in electrical connection to said triggering element, the switching arm movable under the action of the joining arm and the rotatable angle arm;

a fixed contact for making electrical connection to said switching arm and thereby to said triggering element, the electrical connection between the switching arm and the fixed contact broken by movement of the switching arm under the action of the joining arm and the rotatable angle arm;

at least one further stressing device connected to the switching arm for breaking of the electrical connection between the contact and the switching arm upon releasing of the connection between the release arm and the rotatable angle arm; and a switching lever in spring connection with the rotatable angle arm for manually rotating the rotatable angle arm and returning the switch to a switched on position in which the contact is in electrical connection with the switching arm.

12. A switch according to claim 10 wherein said switching amplification means comprises:

a fixed hinge;

a release arm rotatable about the fixed hinge and connected to the stressing device and the triggering element;

a rotatable angle arm releasably connected to said rotatable release arm whereby the connection of the release arm to the rotatable angle arm is released upon contraction of the triggering element against the action of the stressing device;

a joining arm braced at one end to the rotatable angle arm and transferring motion of the rotatable angle arm;

a switching arm pressed by the joining arm and in electrical connection to said triggering element, the switching arm movable under the action of the joining arm and the rotatable angle arm;

a fixed contact for making electrical connection to said switching arm and thereby to said triggering element, the electrical connection between the switching arm and the fixed contact broken by movement of the switching arm under the action of the joining arm and the rotatable angle arm; and, at least one further stressing device connected to the switching arm for automatically returning the switching arm into electrical connection with the fixed contact after cooling of the triggering element.

* * * * *